US005505337A

United States Patent [19]

Littman et al.

[11] Patent Number: 5,505,337

[45] Date of Patent: Apr. 9, 1996

[54] HYGIENIC TOOTHPASTE DISPENSER AND STAND

[76] Inventors: Carrie W. Littman, 3210 Drexel Dr., Wilmington, Del. 19810; Kenneth C. Wenzer, 11538 February Cir. #402, Silver Spring, Md. 20904

[21] Appl. No.: 330,246

[22] Filed: Oct. 12, 1994

[51] Int. Cl.[6] ..... B65D 35/38

[52] U.S. Cl. ..... 222/92; 222/185.1; 222/330; 222/482; 222/547; 239/279; 239/565

[58] Field of Search ..... 222/92, 185.1, 222/330, 478, 481, 482, 547, 564; 239/279, 565, 548; 248/163.1, 176, 177, 187

[56] References Cited

U.S. PATENT DOCUMENTS

| | | | |
|---|---|---|---|
| 1,375,030 | 4/1921 | Watkins et al. | 222/482 |
| 3,606,103 | 9/1971 | Taylor | 222/478 |
| 3,718,243 | 2/1973 | Bagguley | 222/185.1 X |
| 4,142,651 | 3/1979 | Leopoldi et al. | 222/185.1 |
| 4,386,718 | 7/1983 | Stewart et al. | 222/482 X |
| 4,528,180 | 7/1985 | Schaeffer | 222/92 X |
| 4,695,021 | 9/1987 | Leinfelder | 248/163.1 X |

FOREIGN PATENT DOCUMENTS

| | | | |
|---|---|---|---|
| 2224320 | 5/1990 | United Kingdom | 222/92 |

*Primary Examiner*—Joseph A. Kaufman
*Attorney, Agent, or Firm*—Robert Halper

[57] ABSTRACT

A hygienic toothpaste dispenser for selectively distributing toothpaste onto a toothbrush from one of a plurality tubes oriented so as to form a stand for a toothpaste container shaped as a cylinder, the tubes being capped with snap type covers. The tubes have indicia thereon to identify with a specific user.

9 Claims, 1 Drawing Sheet

FIG. 1
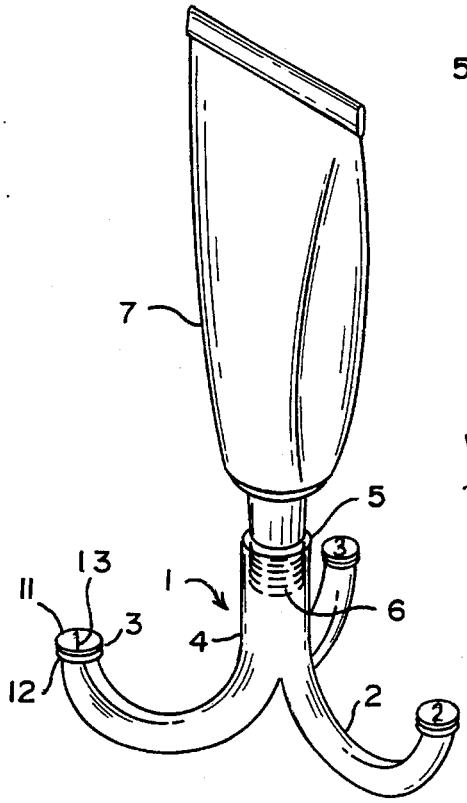
FIG. 7
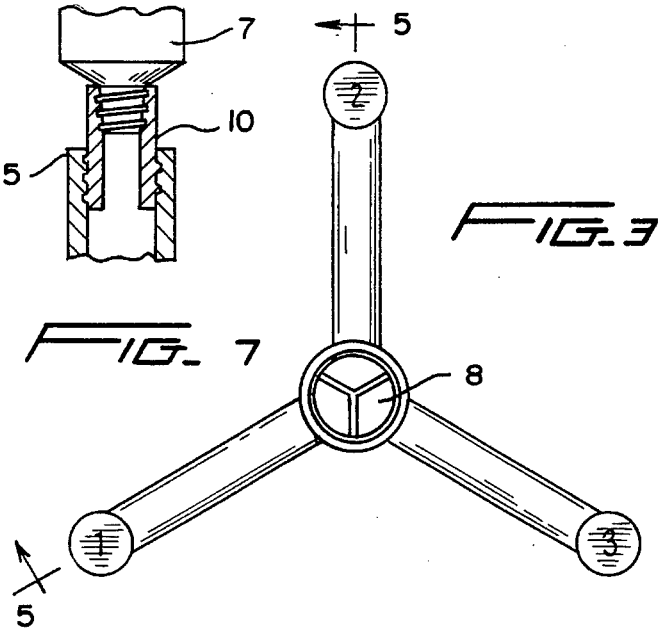
FIG. 3
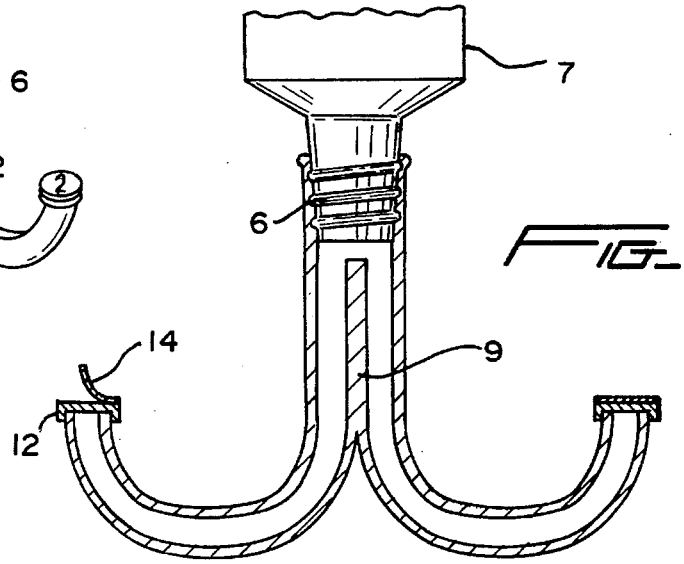
FIG. 5
FIG. 2
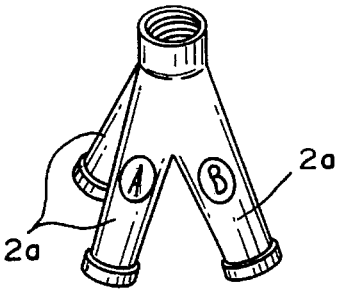
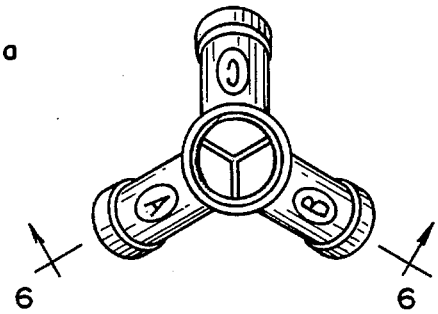
FIG. 4
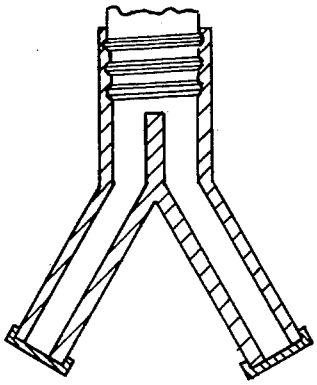
FIG. 6

HYGIENIC TOOTHPASTE DISPENSER AND STAND

BACKGROUND OF THE INVENTION

This invention is concerned with dispensers for toothpaste where the dispenser also serves as a stand. It has now been recognized that the dispensing portion of the toothpaste tube can easily become contaminated from the presence of microbes on individual brushes, whence such contamination can be transmitted to a another toothbrush.

DESCRIPTION OF THE PRIOR ART

While there are a number of dispensers for delivering a product or products through multiple chambers, only one has been found pertaining to the delivery of toothpaste.

U.S. Pat. No. 3,190,499 shows a container of cylindrical or square shape for delivering liquids. The container is divided into a plurality of chambers.

U.S. Pat. No. 3,591,053 teaches a sanitary toothpaste dispenser and is most pertinent to the present invention. A toothpaste tube is threadably attached to a threaded extension of a rectangular container. Projecting upwardly in an opposite direction from the extension are a plurality of nozzles, spaced apart and provided with caps. The nozzles are about the same diameter as the threaded extension for the toothpaste tube. Toothpaste can be selectively dispensed from each of the nozzles onto a toothbrush by removing an individual cap and allowing the paste to flow onto the designated tube. To assign a certain tubular member to a specific individual, the tubular members are made of different lengths. Also the various closures for the tubular members may be of different colors.

U.S. Pat. No. 5,062,550 shows a dispenser having a cap. Attached to the cap are a plurality of spaced conduits. Each conduit has different sized openings of varying shapes to permit varying flow rates through each conduit so that there can be selective volumetric dispensing of the product within the container.

U.S. Pat. No. 5,114,044 illustrates the use of-two or more plastic pastry tubes of conical shape held together and connected at their lower ends to semi-circular nozzles. When the tubes are squeezed, plural colored ribbons of icing or vegetables in closely adjacent designs can be dispensed together.

U.S. Pat. Des. No. 279,548 shows a toothpaste container where the container is in the shape of a toothbrush. At the end away from the brush there appears to be a semi-spherical cap. There seems to be no indication that when the container is squeezed, that toothpaste will flow out onto the section that contains the toothbrush shape.

SUMMARY OF THE INVENTION

As indicated above only one of the aforementioned containers is concerned with dispensing toothpaste for a toothbrush. While the toothpaste dispenser of U.S. Pat. No. 3 591 053 is manifestly a sanitary dispenser, there are several disadvantages inherent in the design. To achieve the objective of dispensing the tube must be gripped manually and the toothpaste is pushed upwardly against the force of gravity into the container or alternatively the tube could be inverted and the tube and the container held manually. Furthermore, after the user is finished with the dispenser, the method of storage is necessarily awkward. The tube and its container would have to be set down horizontally or the tube would have to be unscrewed from the container and both tube and container would have to be recapped. Another disadvantage is that a rectangular container as shown not only would take up a considerable amount of space, but it would require greater sustained pressure to force the paste through the container to the selected nozzle.

Accordingly it is an object of this invention to produce a hygienic dispenser and stand which eliminates the disadvantages of the aforementioned toothpaste dispenser.

It is a further object of this invention to produce a hygienic dispenser and stand which is user friendly and requires no special efforts to find storage space.

It is still an object of this invention to produce a hygienic dispenser and stand which can be easily manipulated without requiring excessive pressure to distribute the paste.

It is a further object of this invention that the dispenser is used in such a way that its hygienic properties are not inadvertently disrupted.

The design of this toothpaste dispenser is made so that it has tubes or nozzles that devolve from a shaped container to form a stand resting on a support surface and the toothpaste tube is inverted and screwed into the top of the dispenser. Once the tube is placed in the dispenser top, it need not be removed until such time as the paste is exhausted. The container could be in the form of a cylinder or other geometrical shape and the container would be subdivided into chambers as determined by the number of nozzles and the nozzles would be capped until a user wanted to obtain toothpaste. Indicia on the cap or tube would inform the user which nozzle was his or hers. By using an upright container the volume is concentrated so that capacity is a function of height and diameter rather than a function primarily of length as shown in U.S. Pat. No. 3,591,053. Furthermore, by taking advantage Of gravity, the flow rate is not only improved, but the pressure required to remove the paste from the tube is lessened.

BRIEF DESCRIPTION OF THE DRAWINGS

FIG. 1 is a perspective view of one embodiment of the invention.

FIG. 2 is a perspective view of another embodiment of this invention.

FIG. 3 is a plan view of the one embodiment shown in FIG. 1.

FIG. 4 is a plan view of the other embodiment shown in FIG. 2

FIG. 5 is a front sectional view taken on line 5—5 of FIG. 3 showing the divider plates and the peelable indicia.

FIG. 6 is a front sectional view taken on line 6—6 of FIG. 4.

FIG. 7 is a partial front section showing the use of an adapter.

DETAILED DESCRIPTION OF THE INVENTION

FIG. 1 shows a toothpaste dispenser 1 with 3 nozzles or tubes 2 having caps 3 to cover each nozzle or tube. The container is in the form of a cylinder 4 which stands about 6" to 8" from the supporting surface to the top of the cylinder. The inside diameter of the cylinder would be about 9/16", which is about the size of a standard toothpaste cover. The inside surface would have threads 5 to accomodate the threads 6 of a standard toothpaste tube 7. Below the threaded interior surface the cylinder is divided into equal sized chambers 8 corresponding to the number of tubes or nozzles for toothpaste dispensing. The cylinder would be about 4" to 5" in height from whence the cylinder would devolve into a plurality of tubes occupying a height of 1" to 1½" from their tops to their bottoms adjacent a support and the radial distance from a line drawn through the center of the cylinder to the center of the tubes would be about 2½" to 3". The total height of the dispenser from top to the base or bottom would be about 6" to 8". The chambers would be divided by a plurality of vertically extending divider plates 9 whose inner ends would intersect at the center of the cylinder. The plates could be made as individual units and be adhesively bonded to the interior walls of the cylinder at the point of intersection or they could be preformed as an integrated member. These plates extend downwardly from an area slightly below where the toothpaste tube threads into the cylinder to the point where the cylinder devolves into a plurality of tubes or legs. As shown in FIG. 1 the tubes would be curved in the form of an arc and the diameter of the tubes would be equal to that of the cylinder divided by the number of tubes. These bottoms of these tubes that are positioned on a support would preferably be Slightly flattened to improve their static stability. In FIG. 2 the cylinder would devolve into the form of tubes or legs **2*a* extending angularly and outwardly from the cylinder to form a triangular base, but the radial distance from a line through the center of the cylinder to the center of the tubes would be about 1" to 1¼".The aforesaid dimensions are exemplary and could be varied depending on space available or for aesthetic reasons. While the Figures show three tubes, more could be accommodated; however, if there were more than three tubes, the cylinder diameter of the container would have to be enlarged and an adapter 10 would be necessary to allow connection between the standard toothpaste tube and the enlarged diameter of the cylinder, since there is a limit to the diameter of the tubes that could be used. Caps 11 of the snap fit type cover each nozzle and would consist of a top 12 and a depending rim 13. To insure that each user would always use the same tube dispenser, each cap or leg would have a peelable disc 14 over its top as in FIG. 1 or on its leg as in FIG. 2**, which would have a number or letter imprinted thereon. Such indicia would be identified with a particular user. The dispenser is preferably made of a hard plastic, chemically resistant material such as an acrylic, in particular polymethylmethacrylate.

The subject matter of this invention has been described, but it should be understood to those skilled in the art that many modifications, substitutions or variations of the invention are possible in light of the above teachings. It is therefore to be understood that within the scope of the appended claims the invention may be practiced otherwise than as specifically described.

I claim:

1. A hygienic toothpaste dispenser comprising a top and a base, said top being in the form of a cylinder and extending downwardly to an intermediate region, said cylinder having internal walls and at said intermediate region devolving into a plurality of tubes of diminished diameter with respect to said cylinder, each tube extending angularly downwardly and outwardly and being equally spaced from each other, said tubes having bottoms which are positioned on a planar surface and serve as a stand for said dispenser, said top having internal threads and of such diameter as to mesh with the external thread of a toothpaste tube, said cylinder containing dividers, each said divider having one end that insersects with said one end of said other dividers at the center of said cylinder, said dividers defining chambers that extend from below said internal threads to said intermediate region, where said cylinder devolves, said dividers being adhesively bonded to said inner walls of said cylinder and at the point of intersection, said tubes having circular openings and snap fit caps and acting as dispensers for selectively distributing toothpaste.

2. The hygienic dispenser of claim 1 wherein said tubes are arcuately curved and extend outwardly and upwardly from said intermediate region.

3. The hygienic dispenser of claim 1 wherein said tubes are equally spaced from each other, and extend downwardly and outwardly from said cylinder to form a triangular base.

4. A hygienic dispenser as in claim 3 wherein said tubes have peelable discs with indicia imprinted thereon.

5. A hygienic dispenser as in claim 1 wherein said caps comprise a cover and a depending rim and contain indicia on said cover, each of said indicia identifying with a specific user.

6. A hygienic dispenser as in claim 5 wherein said indicia are letters or numbers imprinted on peelable discs placed over said covers.

7. A hygienic dispenser as in claim 1 wherein said dividers are preformed as an integrated member.

8. A hygienic dispenser as in claim 1 wherein said dispenser is made of a hard, chemically resistant plastic material.

9. A hygienic dispenser as in claim 1 wherein diameter of said cylinder is larger than that which would accommodate a standard toothpaste tube and a threaded adapter is interposed between said toothpaste tube and said cylinder.

* * * * *